United States Patent [19]

Schlumpf

[11] 4,296,873

[45] Oct. 27, 1981

[54] AUTOMATIC VENDING ARRANGEMENT

[75] Inventor: Alois Schlumpf, Zumikon, Switzerland

[73] Assignee: Tax o mex AG, Switzerland

[21] Appl. No.: 102,362

[22] Filed: Dec. 11, 1979

[30] Foreign Application Priority Data

Dec. 12, 1978 [CH] Switzerland ..... 12645/78

[51] Int. Cl.[3] ..... B65H 3/22

[52] U.S. Cl. ..... 221/213

[58] Field of Search ..... 221/214, 213, 227, 217, 221/231, 232, 236; 271/18.3, 31, 38

[56] References Cited

U.S. PATENT DOCUMENTS 2,504,990 4/1950 Leschin ..... 221/213 X 3,716,226 2/1973 Kistner ..... 271/31

*Primary Examiner*—Stanley H. Tollberg

*Attorney, Agent, or Firm*—Scully, Scott, Murphy & Presser

[57] ABSTRACT

An automatic vending arrangement in which newspapers are horizontally supported on a support table. The table with a set of pulleys has a spring exert a force on the pulley in an upward direction. A sensor on a pivot arm has a pin extend into a sprocket wheel of a chain pulley through the lifting of the table so as to arrest the latter at that height. Manipulation of a handgrip causes the uppermost newspaper to pivot about the support point of the sensor to project out of a dispensing slot so as to be grasped and pulled out by a customer.

6 Claims, 3 Drawing Figures

AUTOMATIC VENDING ARRANGEMENT

BACKGROUND OF THE INVENTION

1. Field of the Invention

The present invention relates to an automatic vending arrangement for the sale of newspapers or periodicals.

Arrangements of that type which are also designated with the terminology such as apparatus for the dispensing of newspapers, newspaper vending automats or newspaper dispensers, have been known for a considerable period of time. However, the fact that this type of automatic vending machine which has been developed to a high degree of sophistication for the dispensing of beverages or other objects which are in daily use, has not been successful and leads to the conclusion that either the manipulation, the dependability during operation or both in combination are inadequate to satisfy either customer or vendor requirements.

An obvious difficulty which is encountered in the automatic vending of newspapers, periodicals, brochures, catalogs, or other folded paper articles, such as shopping bags and the like, consists of in that these articles of sale possess large dimensions in comparison with the thickness of the material. For example, known newspapers of a usual format of 47×33 centimeters are singly folded in height when they are placed on sale. The nature of the thin paper leads to that the individual sheets can be easily displaced relative to each other. Thus, when such a large-sized pile of papers is now displaced through an automat to such an extent whereby a sufficient area projects out of the housing to allow for the gripping thereof, on the one hand, this will then require a clamping pressure so that the pile of loose sheets can be displaced as an entity and, on the other hand, there should be produced the least possible friction between the remaining stack and the newspaper being dispensed such that the dispensing of one copy cannot cause damage to the subsequent copy.

2. Discussion of the Prior Art

From German Laid-open patent application Ser. No. 2 034 661 there has become known that newspapers within a housing which are stacked on a plate which is upwardly pressed through springs can be retained at a rear portion which is located remote from a delivery slot in the housing by means of a braking element, and wherein the uppermost newspaper can be pushed through the slot by means of a stationarily supported roller arranged proximate the dispensing slot and which is set into rotational movement through the action of a lever. The roller is provided with needle points and extends over the entire width of the newspaper. An obvious disadvantage consists of in that the roller must concurrently form the counterforce for the springs for the elevation of the plate so as a result in a squeezing of the newspaper whereby the newspaper will more likely be opened at the fold than be pushed out of the slot as an entirety.

This disadvantage is obviated by the disclosure of German Laid-open patent application Ser. No. 2 503 596 in that not only the plate on which there rests the stack of newspapers is pressed resiliently upwardly, but wherein the dispensing arrangement is also displaceable in such a manner that the plate, the support for the dispensing arrangement and the stack is resiliently balanced such that the uppermost located newspaper is maintained at practically a constant level. Furthermore, means are provided through which the uppermost newspaper is engaged from below when effecting the dispensing. Moreover, there are also provided striker bars against which the stack is pressed by the action of the springs. This will obviate the disadvantage of requiring the dispensing rollers to provide the counterpressure for the springs. However, the construction of the dispensing arrangement which is required is quite complex when considering the different sequences of motion which must be effectuated by the only short linear movement of a handgrip.

Heretofore, when the newspapers were located on a horizontal plate and slid outwardly in a horizontal direction, as indicated in German Laid-open patent application Ser. No. 2 553 309 had also become known that the newspapers could be stacked vertically. By means of a resilient back sheet metal plate and a contact pressure arm, the newspapers which are located behind a bar are pressed against a contact pressure plate, so as to thereby deflect. Upon the actuation of a handgrip, a first element which is provided with gripper needles is moved upwardly so that the newspaper is raised above the bar and can extend itself due to gravity. Thereby, the newspaper is positioned above the dispensing slot and is conducted into the dispensing slot by the downwardly directed movement of a second element which is similarly provided with gripper needles. On the one hand, this will not ensure that only one newspaper will be raised above the bar which, moreover, is arranged at a fixed distance relative to the contact pressure plate. On the other hand, it is known that at opposite movements with tiltably supported gripper elements it is not always ensured that the gripper element will dependably release. If this is not the case, then at least the one sheet of the newspaper will be torn.

SUMMARY OF THE INVENTION

Accordingly, it is an object of the present invention to provide a simply constructed automatic vending machine for newspapers or the like in which there is ensured that, for each actuation of the lever, but only when a correct payment has been inserted there will always be dispensed one newspaper. Hereby, the gripper elements should effectuate a movement which slides the newspaper and, in addition thereto, the newspapers should be superimposed on each other without pressure and nevertheless always be adjusted in height to render it possible to displace a newspaper by means of a gripper element without the use of a large force.

BRIEF DESCRIPTION OF THE DRAWINGS

Reference may now be had to the following detailed description of a preferred embodiment of the invention, taken in conjunction with the accompanying drawings; in which.

DETAILED DESCRIPTION

Figure 1:
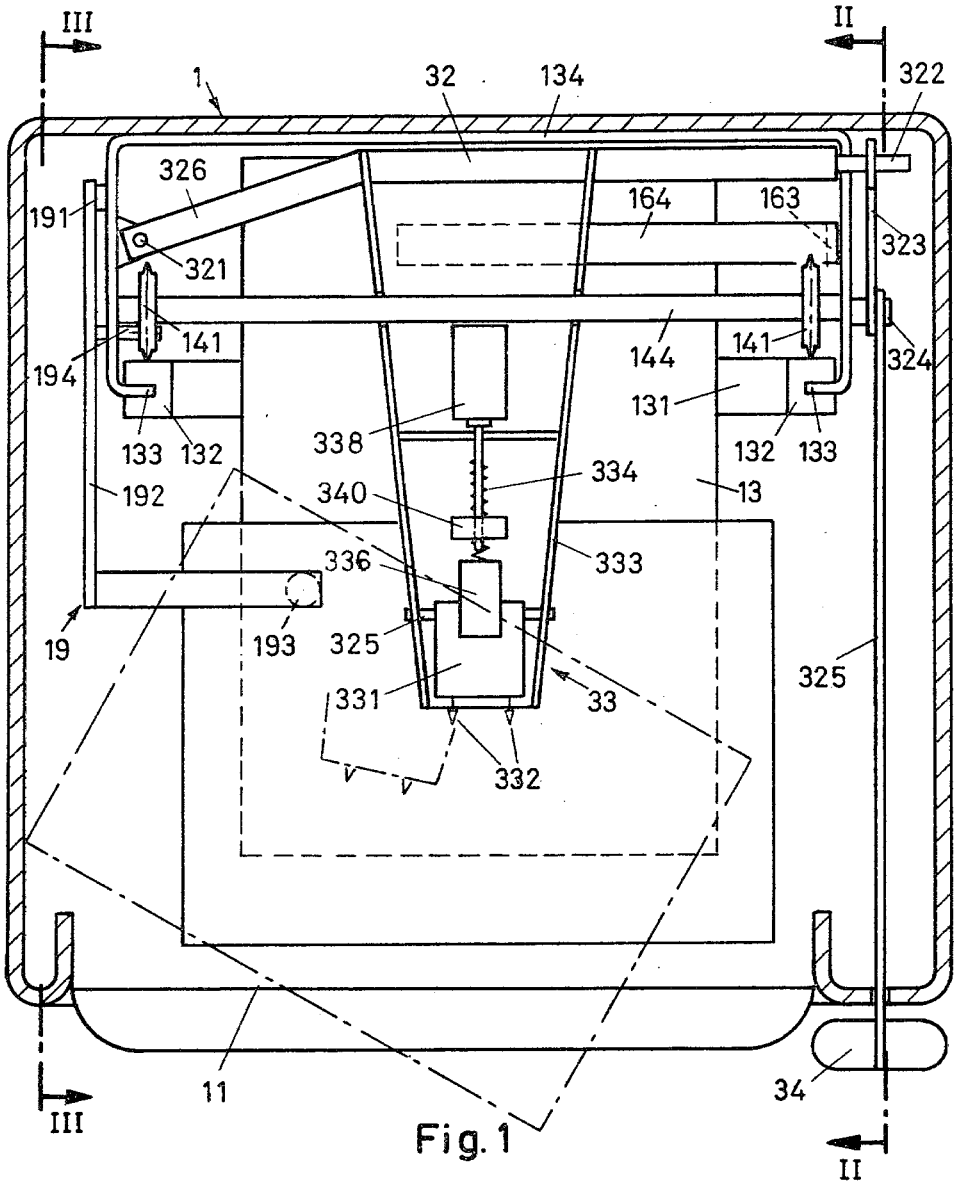
FIG. 1 illustrates a top plan view of an automatic vending machine with the cover plate of the housing shown removed for purposes of clarity.

The housing 1 of the automatic vending machine consists of a floor, a rear wall, two side walls, and a cover wall. A front plate 10 is hinged to the bottom plate by means of a hinge 116 and, together with a flange projecting downwardly from the cover wall, forms a delivery slot 11 for newspapers or the like. Arranged in the front plate 10 are all operating elements for the actuation and servicing of the automatic vending machine, such as the slots 110, 111, 112 for the insertion of money, namely for example, nickels, dimes and quarters, although further slots can naturally also be provided for larger coins or other monetary units. A return knob and associated return cup 115, a locking arrangement 114, as well as an empty machine indicator 116 are also located inside the front plate 10. A handgrip 34 with a lever arm extends in a known manner through a vertical slot provided in the front plate.

A vertically movable support table 13, including guide rail 133 and slides 132 which are arranged to the left and the right of the table, is provided for the deposit of the newspapers. The two slides 132 are connected with a table carrier 131. The guide rails 133 are angled flanges on a mounting plate 134 on which there are retained all of the arrangements relating to the dispensing of the newspaper.

The support table 13 is suspended on sets of pulleys 14 which are similarly arranged on both sides thereof. The lifting units which are constructed as pulley chain hoists each consists of a guide sprocket roll 141 which is rotatably supported on a positionally fixed pivot bearing 144, a pulley with a pulley chain roll 142 and a chain which at one end is fastened to the slides 132 of the table 13 and at the other end at a fixed upper point to the mounting plate 134. The two pulleys with the pulley chain rolls 142 are each pulled downwardly through a tension spring 18. The two tension springs 18 together must exert such a force that the support table 13 fully loaded with newspapers is dependably raised. In order to avoid the need for pressing the table downwardly during the filling with newspapers, the tension springs 18 are each fastened to a rotatably supported angle lever 161 which, together with a pull lever 162 hinged thereto, is similarly hingedly fastened on the front plate 10. Thus, when the front plate 10 is swung down about the hinge 116 as the turning point in a counterclockwise direction, the angle levers 161 rotate about the pivot bearings 165 which are fixed on the housing, and the springs 18 are unloaded whereby the support table 13 under its own weight will lower itself by twice the height of the lift of the end points of the springs 18. Through the closing of the front plate 10 the springs 18 are tensioned and thereby the support table 13 is raised to the correct height.

The setting of this correct height is carried out by means of a sensor 19, a sensor arm 192 supported on the mounting plate 134 by a pivot bearing 191, having a sensor feeler 193 at the free end thereof and a sensor pin 194 on a point on the sensor arm 192 proximate the guide chain roll 141 for engagement with the sprockets of one of the two sprocket rolls 141. Since the fixed support of the two sprocket rolls 141 is a through extending axle 144, as seen in FIG. 1, both sets of pulleys can be rendered motionless in the same manner through the sensor pin 194. As can also be ascertained from FIG. 1, the sensor feeler 193 is arranged above the left forward corner of the support table 13. When the support table 13, with or without newspapers thereon is raised by the sets of pulleys 14, then the letter can be operative with the described sensor 19 only for so long until the sensor feeler 193 is raised and thereby also the sensor pin 194 comes into engagement with sprocket chain roll 141. Accordingly, the springs 18 are only effective as long as the support table is in motion. Thereafter the springs 18 have no further effect. As a result, the springs can be scaled pursuant to the force required from them for the raising of a fully loaded support table or platform without being able to influence the dispensing of a sold newspaper.

Figure 2:
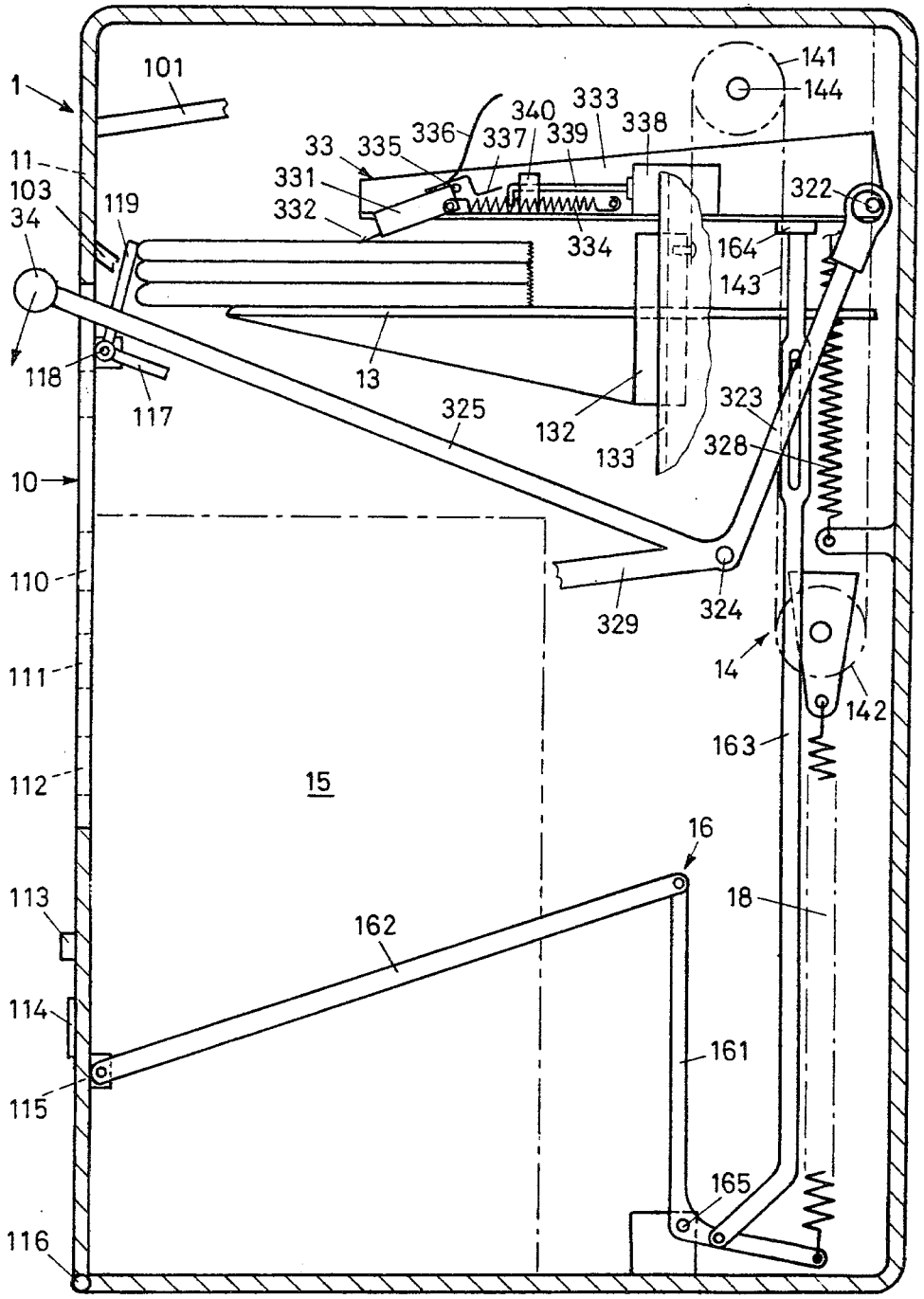
FIG. 2 is a right side elevational view of the automatic vending machine with the right side wall shown removed.
Figure 3:
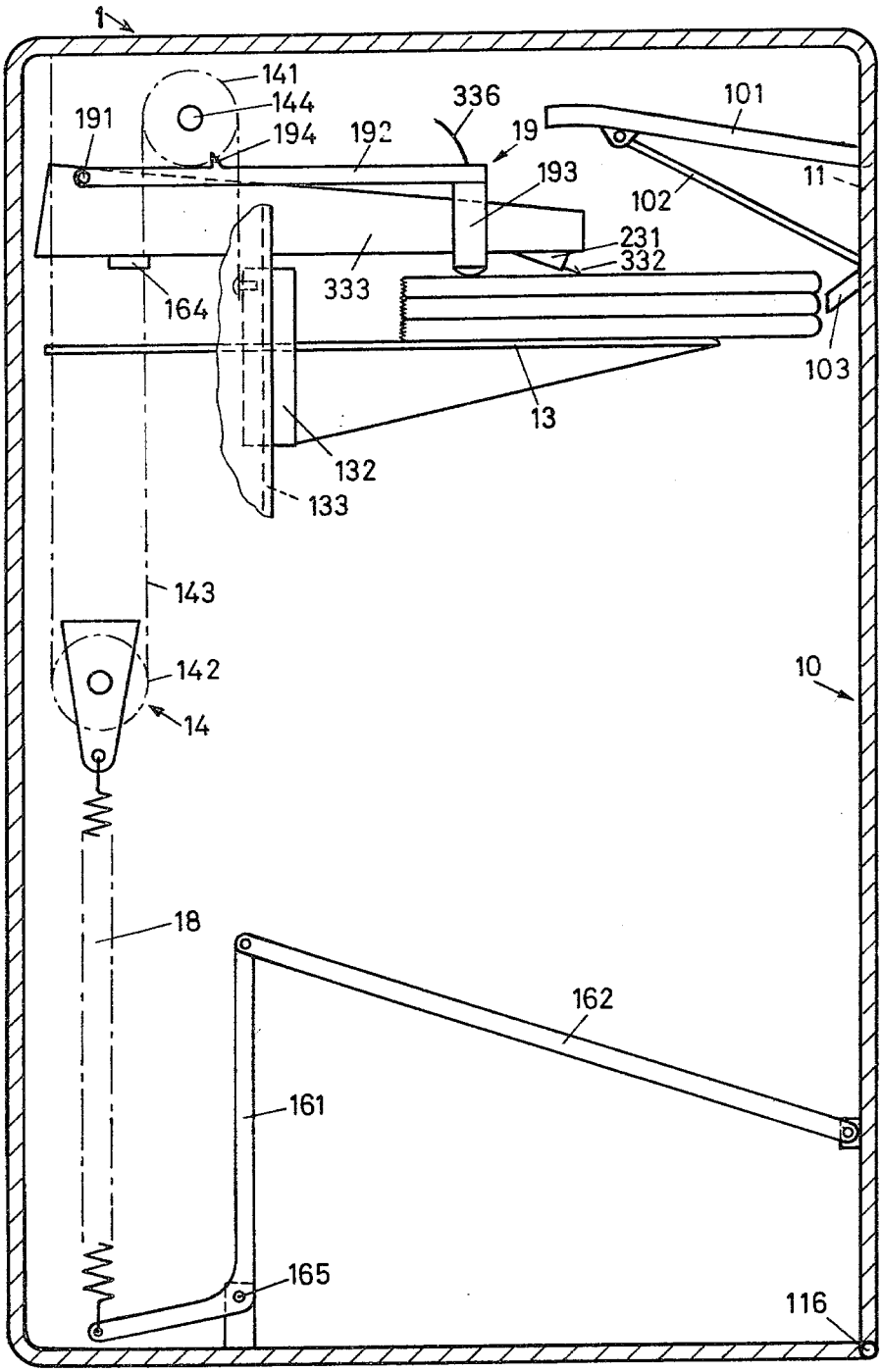
FIG. 3 is a left side elevational view similar to that of FIG. 2 with the left side wall shown removed.

The construction of the gripper 33 can be ascertained from FIGS. 1 and 2. The gripper 33, together with a gripper arm 333 and a gripper pawl 331 is pivotable in height about a horizontal axis. This axis is formed by a pivot arm 32 whose one end, shown at the left in FIG. 1, is hinged to a vertical pivot axle 321 so that the pivot lever 32 is horizontally pivotable about this point. This vertical pivot axle is fastened on the mounting plate 134. The free end 322, shown on the right in FIG. 1, forms a pivot joint for the actuating arm 323 which is unitarily connected with the lever arm 325 carrying the handgrip 34 and is pivotable in a vertical plane about a horizontal rotational axle 324.

When the handgrip 34 is actuated, in effect, moved downwardly, the end 322 of the pivot lever 32 describes an arc about the pivot axle 324 as the centerpoint. As a result, the gripper 33 is also moved and describes an arc about the vertical pivot axle 321 as the centerpoint of the arc.

The gripper arm 333 rests on a gripper support 164 which is linked by means of gripper upright 163 to the angle lever 161 at the right side in FIG. 1, as shown in the side of FIG. 2. Through a bolt 165 extending from the mounting plate 134 and an elongate aperture 166 in the gripper upright 163, the latter is guided so that at the opening of the front plate 10, due to the pivoting of the angle lever 161, the gripper upright 163 and thereby the gripper support 164 are moved upwardly whereby also the gripper arm 333 is moved upwardly about the pivot lever 32 as the pivot axis. This movement has the purpose to convey the gripper 33, in particular the gripper pawl 331 with the gripper needles 332 out of the space for the newspapers and into a shielded zone below the cover wall so that, on the one hand, the gripper pawl cannot be damaged during loading of the support table and, on the other hand, will not create the danger of injury to the servicing personnel.

The gripper 33 additionally incorporates an electromagnet 338 for the release of the gripper pawl or latch 331 when the correct purchase price has been paid in. The armature of the electromagnet 338 is connected with an actuating rod 339 which is guided by means of a support 340. A spring 334 pulls the actuating rod 339 against the gripper pawl 331 which is supported so as to be pivotable in elevation by means of a horizontal axle 335 in the gripper arm 333. On the side remote from the gripper needles 332, the gripper pawl 331 includes a resilient blade 336 for raising the gripping pawl 331 and a latching arm 337.

In the inactive position, the actuating rod 339 rests on the latching arm 337 and retains the gripper pawl 331 in a horizontal or slightly upwardly tilted position. When the electromagnet 338 is actuated, then it pulls the actuating rod 339 back and the gripper pawl 331 turns counterclockwise under the effect of gravity so that the gripper needles contact the uppermost newspaper. The resilient blade 336 is located above the latching arm 337, and is pressed downwardly at the forward rotation of the gripper arm 333 into the extended position through a rising plate 101 on the housing which, for example, is the upper lip of the dispensing slot 11, until the actuating rod 339 comes into engagement with the latching arm 337.

The return positioning of the handgrip 34 is effected by means of a return spring 328 whose end connection is on the housing. A tilt lever 329 is fastened to the lever arm and forms an actuating rod leading to the coin box station 15. Thusly, when the handgrip 34 is moved downwardly the tilt lever 329 will also tilt and actuate the money intake in the coin box station 15.

The operation of this automatic vending machine is quite simple.

To fill the machine, the front plate 10 is swung down forwardly about the hinge 116. Thereby, the connecting point of the spring 18 for the elevation of the support table 13 is raised and the table is lowered. However, the gripper 33 is also raised by the gripper upright 163 so as to clear the receiving space for the newspapers. Through raising of the money return cup 129, the coin box in the coin box station 15 becomes accessible and can be exchanged with an empty coin box. After the newspapers have been deposited on the table 13, the front plate 10 is swung upwardly and closed. The automatic vending machine is then operative.

When a customer has inserted the required amount of money in coins, wherein the coins may be tested, for instance, through calibration, they will close a current path and thereby generate an impulse. This impulse is evaluated in an electronic counter arrangement (not shown) and when the required amount is recognized, the magnet 338 in the gripper 33 is excited and the gripper pawl 331 drops with its gripper needles 332 on the uppermost newspaper. With the return knob 113 there can be generated a resetting signal for the electronic counter arrangement. When there is now actuated the handgrip 34, the gripper arm 333 is rotated about its point of rotation 326 at the end of the pivot lever 32 and the gripper needles 332 push the newspaper in an arc, with the centerpoint being at the sensor feeler 193, out of the dispensing slot 11. At that location there appears a corner of the newspaper which can be grasped and the newspaper thereby pulled out. The gripper arm then again returns. The gripper pawl moves below the inclined plate 101 with the resilient blade 336 and this again locates the gripper pawl in its initial position. Inasmuch as the sensor arm 192 falls downwardly due to the absense of the newspaper, the sensor pin 194 releases the sprocket wheel 141 and the newspaper stack is raised up to the sensor feeler 193 under the biasing force of spring 18; the sensor feeler 193 now raising the sensor arm 192 and thereby also allowing the sensor pin 194 to engage in the sprocket roll 141 so as to render the spring force ineffective. Since the newspaper is pressed only at one point, namely at the sensor feeler 193, there is produced an ideal point of rotation for the rotational movement for the newspaper when the gripper 33 exerts the arcuate dispensing movement.

According to FIG. 2 there can be provided an arrangement for indicating the presence or absence of newspapers. In the simplest instance, this can consist of a drop indicator which is provided with the legend "EMPTY" on an indicator arm 117 and which is rotatably fastened to a support 118 on the front plate 10. A sensor arm 119 is then located on the fold of the newspaper in such a manner whereby, when the last newspaper has been removed, the sensor arm 119 will fall downwardly and the word "EMPTY" will appear in an indicator area in the front plate 10.

What is claimed is:

1. In an automatic vending arrangement for the sale of newspapers or periodicals, a housing having a dispensing slot at the upper front side thereof; including a cash box arrangement and a dispensing arrangement, said cash box arrangement including coin testing means, coin return means and coin receiving means; and actuating means for said dispensing arrangement, said dispensing arrangement including a vertically displaceably guided support table and a lever-actuated dispenser, the improvement comprising: at least one set of pulleys for raising said support table having one end of the pulley fastened to said table and another end to said housing; spring means for pulling said pulley downwardly; sensor means having sensor arm means supported in a horizontal pivot bearing at one end thereof, including a sensor feeler directed against said support table and sensor pin means engageable in the raised position into a sprocket roll for rendering stationary said set of pulleys; a pivot lever pivotable in a horizontal plane about a vertical rotational axle arranged sidewise of the area of said support table; linkage means connecting the free end of said pivot lever with a handgrip for changing a direction of movement; and a gripper arm being vertically movably linked to said pivot lever and arranged at least approximate the middle axis of said support table, said gripper arm including a vertically movable gripper pawl linked thereto having gripper needles and release and latching means for said gripper latch.

2. Arrangement as claimed in claim 1, one said set of pulleys being located on either side of said support table, said pulleys having sprocket rolls arranged on a common axle and secured against rotation.

3. Arrangement as claimed in claim 2, said sets of pulleys comprising chain pulleys, said pulling means being chains, said sensor pin being directed for engagement into the sprockets of the pulley sprocket rolls.

4. Arrangement as claimed in claim 3, said springs for loading the sets of pulleys having their ends connected to a rotatably supported angle lever, said angle lever having an arm rotatably supported through a pull lever with an openable front plate of said housing whereby said sets of pulleys are unloaded at the opening of said housing and the support table can automatically lower itself.

5. Arrangement as claimed in claim 4, comprising a gripper support having said gripper rest thereon, said gripper support having a gripper upright linked to said arm of said angle lever, said spring means being connected to said arm whereby upon opening of the housing there is raised said gripper and the gripper needles are brought into a region within said housing so as to at least render difficult injuries to operating personnel during loading of said arrangement.

6. Arrangement as claimed in claim 1, comprising an electromagnet in the gripper arm of said gripper, said electromagnet having an actuating rod resting on a latching means whereby at the pulling of said magnet there is released said latching means, and the gripper pawl which is rotatably supported for movement about a rotational axis together with the gripper needles falls downward upon the newspaper.

* * * * *